United States Patent [19]

Jackson

[11] Patent Number: 5,006,307

[45] Date of Patent: Apr. 9, 1991

[54] HAFNIUM CONTAINING NIOBIUM, TITANIUM, ALUMINUM HIGH TEMPERATURE ALLOY

[75] Inventor: Melvin R. Jackson, Schenectady, N.Y.

[73] Assignee: General Electric Company, Schenectady, N.Y.

[21] Appl. No.: 279,639

[22] Filed: Dec. 5, 1988

[51] Int. Cl.[5] ..... C22C 14/00; C21D 1/00

[52] U.S. Cl. ..... 420/426; 420/425

[58] Field of Search ..... 420/426, 425

[56] References Cited

U.S. PATENT DOCUMENTS 3,753,699 8/1973 Anderson, Jr. et al. ..... 420/426

FOREIGN PATENT DOCUMENTS 0021357 6/1972 Japan ..... 420/426

0025559 7/1972 Japan ..... 420/426

OTHER PUBLICATIONS

Alloys of Niobium, Poroshkin et al., pp. 130–137 and 245–247, D. Davey Co., N.Y., 1965.

*Primary Examiner*—Upendra Roy

*Attorney, Agent, or Firm*—Paul E. Rochford; James C. Davis, Jr.; James Magee, Jr.

[57] ABSTRACT

An alloy having high strength at high temperature is provided. The alloy has the following approximate composition in atom percent:

| | |
|---|---|
| niobium | balance |
| titanium | 40–48% |
| aluminum | 12–22% |
| hafnium | 0.5–6% |

4 Claims, 2 Drawing Sheets

HAFNIUM CONTAINING NIOBIUM, TITANIUM, ALUMINUM HIGH TEMPERATURE ALLOY

CROSS REFERENCE TO RELATED APPLICATION

The subject application relates to application Ser. No. 202,357, filed June 6, 1988. It also relates to applications Ser. Nos. 280,085, 279,639, and 279,640, filed Dec. 5, 1988; Ser. No. 07/288,667, filed Dec. 22, 1988; and Ser. No. 290,399, filed Dec. 29, 1988. The text of the related application is incorporated herein by reference.

BACKGROUND OF THE INVENTION

The present invention relates generally to alloys and to shaped articles formed for structural use at high temperatures. More particularly, it relates to an alloy having a niobium, titanium, aluminum base and which contains a hafnium additive. By a niobium, titanium, aluminum base is meant that the principal ingredients of the alloy are niobium, titanium, and aluminum.

There are a number of uses for metals which have high strength at high temperature. One particular attribute of the present invention is that it has, in addition to high strength at high temperature, a relatively low density of the order of 6–6.5 grams per cubic centimeter (g/cc).

In the field of high temperature alloys and particularly alloys displaying high strength at high temperature, there are a number of concerns which determine the field applications which can be made of the alloys. One such concern is the compatibility of an alloy in relation to the environment in which it must be used. Where the environment is the atmosphere, this concern amounts to a concern with the oxidation or resistance to oxidation of the alloy.

Another such concern is the density of the alloy. One of the groups of alloys which is in common use in high temperature applications is the group of iron-base, nickel-base, and cobalt-base superalloys. The term "base", as used herein, indicates the primary ingredient of the alloy is iron, nickel, or cobalt, respectively. These superalloys have relatively high densities of the order of 8 to 9 g/cc. Efforts have been made to provide alloys having high strength at high temperature but having significantly lower density.

It has been observed that the mature metal candidates for use in this field can be grouped and such a grouping is graphically illustrated in FIG. 1. Referring now to FIG. 1, the ordinate of the plot shown there is the density of the alloy and the abscissa is the maximum temperature at which the alloy provides useful structural properties for aircraft engine applications. The prior art alloys in this plot are discussed in descending order of density and use temperatures.

With reference to FIG. 1, the materials of highest density and highest use temperatures are those enclosed within an envelope marked as Nb-base and appearing in the upper right hand corner of the figure. Densities range from about 8.7 to about 9.7 grams per cubic centimeter and use temperatures range from less than 2200° F. to about 2600° F.

Referring again to FIG. 1, the group of prior art iron, nickel, and cobalt based superalloys are seen to have the next highest density and also a range of temperatures at which they can be used extending from about 500° F. to about 2200° C.

A still lower density group of prior art alloys are the titanium-base alloys. As is evident from the figure, these alloys have a significantly lower density than the superalloys but also have a significantly lower set of use temperatures ranging from about 200° F. to about 900° F.

The last and lowest density group of prior art alloys are the aluminum-base alloys. As is evident from the graph these alloys generally have significantly lower density. They also have relatively lower temperature range in which they can be used, because of their low melting points.

The usefulness of the titanium-base alloys extends over a temperature range which is generally higher than that of the aluminum-base alloys but lower than that of the superalloys.

A novel additional set of alloys is illustrated in the figure as falling within an envelope of alloy compositions having higher densities than those of the titanium-base alloys, but much lower densities than those of the superalloys. The useful temperature ranges of some of these alloys potentially extend beyond the superalloy temperature range. The range of density and useful temperature for the alloys of the present invention fall within the larger envelope illustrated in the FIG. 1 and particularly within the smaller shaded zone in the left-half of that larger envelope. These novel alloys are formed with a niobium-titanium-aluminum base.

BRIEF STATEMENT OF THE INVENTION

It is, accordingly, one object of the present invention to provide an alloy system which has substantial strength at high temperature relative to its weight.

Another object is to reduce the weight of the elements presently used in higher temperature applications.

Another object is to provide an alloy which can be employed where high strength is needed at high temperatures.

Other objects will be in part apparent and in part pointed out in the description which follows.

In one of its broader aspects, these and other aspects of the invention can be achieved by providing an alloy having a composition in atom percent as follows:

| Ingredient | Concentration Range | |
|---|---|---|
| | From About | To About |
| niobium | balance essentially | |
| titanium | 40 | 48 |
| aluminum | 12 | 22 |
| hafnium | 0.4 | 6 |

By balance essentially, as used herein, it is meant that in addition to niobium in the balance of the alloy, small amounts of impurities and incidental elements may be present where these impurities and incidental elements are in character and/or amount which does not adversely affect the advantageous aspects of the alloy.

BRIEF DESCRIPTION OF THE DRAWINGS

The description which follows will be understood with greater clarity if it is read in connection with the accompanying drawings in which.

DETAILED DESCRIPTION OF THE INVENTION

An alloy is provided pursuant to the present invention having a base of niobium, titanium, and aluminum in specific atomic ratios and having a small amount of hafnium dopant. The presence of the dopant is effective in substantially improving the properties of the alloy as may be inferred from the graphs of FIG. 2 as discussed below.

EXAMPLES 1 and 2

Two alloy samples were prepared by conventional metallurgy steps to have compositions as set forth in Table 1 immediately below:

| | Ingredients and Concentrations In Atom Percent | | | |
|---|---|---|---|---|
| Example | Nb | Ti | Al | Hf |
| 1 | 36 | 42 | 20 | 2 |
| 2 | 30 | 45 | 20 | 5 |

Conventional tensile bars were prepared and tensile properties of the alloys were determined in conventional tensile testing equipment and by conventional methods. The results of these tests are given in Table 2.

TABLE 2

| | Yield Strength (ksi) and Reduction in Area (R) in % | | | | | | | |
|---|---|---|---|---|---|---|---|---|
| Example | Room Temperature | R % | 760° C. | R % | 980° C. | R % | 1200° C. | R % |
| 1 | 146 | 1.5 | 117 | 2.0 | 18 | 96 | 6 | 94 |
| 2 | 158 | 1.7 | 105 | 4.4 | 15 | 93 | 5 | 94 |

Figure 1:
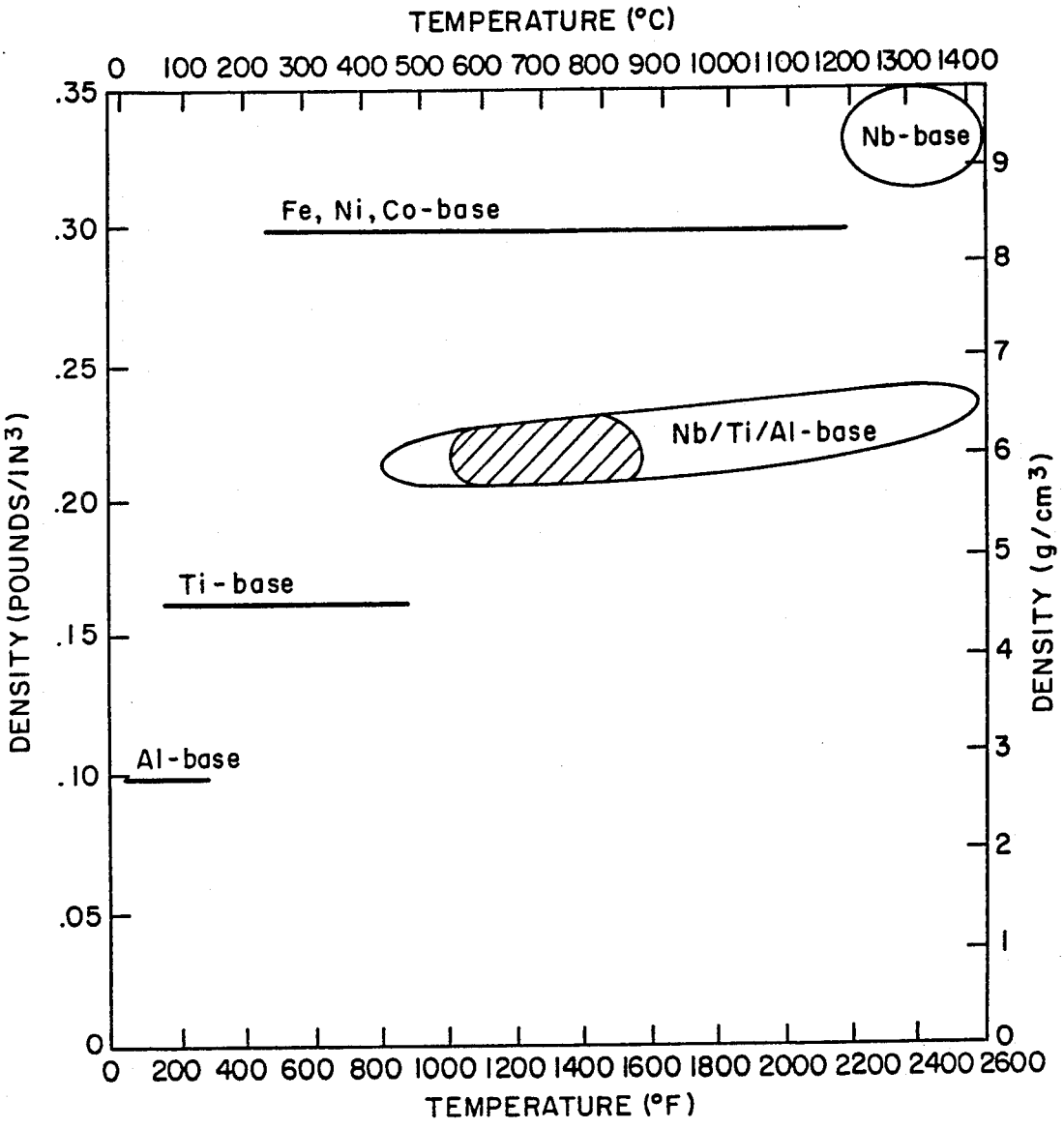
FIG. 1 is a graph in which density of alloy species is plotted against density of the species for several different species of alloys.
Figure 2:
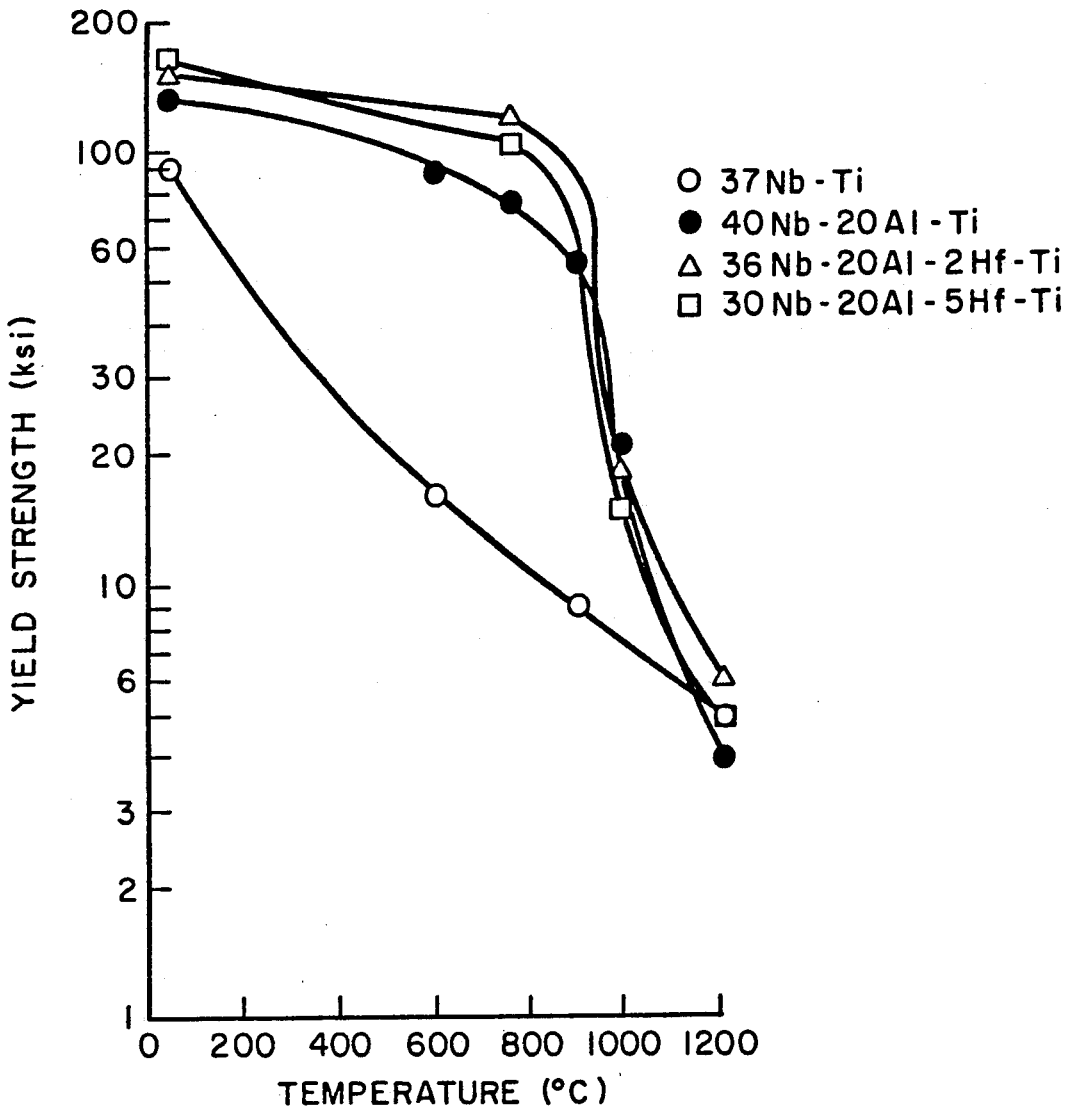
FIG. 2 is a graph in which yield strength in ksi is plotted against temperature in degrees centrigrade for a number of alloy compositions including that of the present invention.

It is evident from the test data set forth in FIG. 2 that the alloy of the present invention has a desirable and beneficial room temperature ductility in that the reduction in area, R, is 1.5 and 1.7 percent respectively for the alloys of Examples 1 and 2. The reduction in area increases as the temperature increases and is at quite high values at temperatures above 900° C.

Data for alloys of examples 1 and 2 are compared in FIG. 2 to data for a Nb-Ti alloy (37 a/o Nb) and for Nb-Ti-Al alloy (40 a/o Nb, 20 a/o Al). The addition of aluminum has a substantial benefit over nearly the entire temperature range from room temperature to 1200° C. The further addition of hafnium to Nb-Ti-Al alloys, as in examples 1 and 2, has a very significant further strengthening effect, especially in the intermediate temperature range from 400° C. to 900° C. (740° F. to 1650° F.). For example, at 760° C., the alloy of Example 2 shows a 35% gain over the alloy without hafnium, and the alloy of Example 1 shows a 50% gain over the alloy without hafnium.

What is claimed and sought to be protected by Letters Patent of the United States is as follows:

1. As a composition of matter an alloy consisting essentially of the following composition in atom percent:

| | Concentration Range | |
|---|---|---|
| Ingredient | From About | To About |
| niobium | balance essentially | |
| titanium | 40 | 48 |
| aluminum | 12 | 22 |
| hafnium | 0.4 | 6 |

2. The alloy of claim 1 in which the hafnium concentration is between 1.5 and 5.

3. The alloy of claim 1 in which the hafnium concentration is between 3 and 5.

4. The alloy of claim 1 in which the aluminum concentration is between 14 and 20% and the hafnium is between 1.5 and 5%.

* * * * *